US005902322A

United States Patent [19]

Scagliotti

[11] Patent Number: 5,902,322

[45] Date of Patent: May 11, 1999

[54] VIBRATING TEETHING RING

[76] Inventor: Livio A. Scagliotti, 6180 St. Albans St., Los Angeles, Calif. 90042

[21] Appl. No.: 09/170,571

[22] Filed: Oct. 13, 1998

[51] Int. Cl.[6] ..... A61J 17/00

[52] U.S. Cl. ..... 606/235

[58] Field of Search ..... 606/235, 234, 606/236; 15/105, 110, 167.1; 601/67, 80, 139–142, 40, 46

[56] References Cited

U.S. PATENT DOCUMENTS

| | | | |
|---|---|---|---|
| D. 365,151 | 12/1995 | Coppels et al. | D24/194 |
| 3,753,266 | 8/1973 | Ceniceros | 606/235 |
| 5,551,952 | 9/1996 | Falgout | 601/139 |
| 5,649,964 | 7/1997 | Berman et al. | 606/235 |
| 5,683,421 | 11/1997 | Guarini, Jr. et al. | 606/235 |

*Primary Examiner*—Gary Jackson
*Assistant Examiner*—Vikki Trinh
*Attorney, Agent, or Firm*—Goldstein & Canino

[57] ABSTRACT

A teething ring, for use by a child, comprising an outer ring, an inner hub, and spokes radially connecting the outer ring and inner hub. The outer ring is made of a material suitable for aiding a teething child such as a semi-hard rubber or plastic, and is selectively dipped in a material most suitable for allowing the child to chew upon. The outer ring is sized so that the child cannot place more than a minor arc thereof in his or her mouth. The inner hub has a vibration mechanism which includes a motor that drives an eccentric weight for generating a vibration sensation. The vibration sensation is transmitted to the outer ring through the spokes. The vibration mechanism, and all electro-mechanical components associated therewith are fully contained within the inner hub and are thereby safely protected from the child.

4 Claims, 2 Drawing Sheets

VIBRATING TEETHING RING

BACKGROUND OF THE INVENTION

The invention relates to a vibrating teething ring. More particularly, the invention relates to a teething ring having a centrally located vibration generation device which transmits a vibrating sensation to an outer ring which a teething child holds within this or her mouth.

As a child's baby teeth begin to erupt through the gumline, the child enters a painful period in his or her development, known as "teething". Since the only way that a young child knows how to communicate is to cry, the child continuously cries in response to his or her pain. It can be quite heartbreaking for a parent to listen to a child cry and know that the child is in pain. Thus, parents go to great lengths to help soothe the child's pain from teething.

An instinctual panacea for teething pain is to chew on small items. Typically young children attempt to chew on anything in sight in response to this urge, and to reduce the pain. Doing so actually enhances the natural eruption of the teeth. However, in an attempt at ensuring the child's safety, parents usually supply the child with so-called teething rings, and other semi-hard plastic and rubber toys designed for this purpose.

In a further attempt to soothe the teething child, some have proposed vibrating teething rings. U.S. Pat. No. 5,551,952 to Falgout discloses a teething ring having a teething member which the child places in their mouth, and provides adjustable vibrations emanating from a vibration mechanism contained therein. However, Falgout raises serious safety concerns, since the vibration unit, the switch, and the battery are all physically located so that they are within the child's mouth during use of the teething ring. If structural integrity of the teething ring were to be compromised during use, the child could be seriously injured. Similarly, U.S. Pat. No. 5,683,421 to Guarini et al. discloses a teething device in which the child might either place the battery compartment or the vibration motor in their mouth.

U.S. Pat. No. 5,649,964 to Berman et al. discloses a vibrating teething ring which includes a handle tube rotatably mounted at the center thereof. The handle tube is induced to rotate by the vibrating mechanism. The teething ring has several radial extension members which project from the teething ring and may be separately placed in the child's mouth. It should be apparent to any parent that several aspects of this device seem inherently unsafe for children.

While these units may be suitable for the particular purpose employed, or for general use, they would not be as suitable for the purposes of the present invention as disclosed hereafter.

SUMMARY OF THE INVENTION

It is an object of the invention to produce a teething ring which helps a child through the teething phase of his or her development development. Accordingly the teething ring has a hard plastic or rubber outer ring which the child chews upon to soothe the pain associated with teething, and to aid the baby teeth in erupting through the gums. The outer ring is sized so that the child cannot place more than a minor arc in his or her mouth.

It is a further object of the invention that the teething ring provides an enhanced soothing effect to the child. Accordingly a vibration generator is present within the teething ring for providing a vibration sensation to the child which dulls the pain associated with teething.

It is a still further object of the invention that the teething ring is configured so that it is safe for use by any child, and presents no danger whatsoever to the child. Accordingly, the vibration generator, a battery for powering the vibration generator, and an on-off switch is safely contained within a hub which is central within and substantially coplanar with the outer ring. Thus, at no time is any electrical or mechanical component inside the mouth of the child.

The invention is a teething ring, for use by a child, comprising an outer ring, an inner hub, and spokes radially connecting the outer ring and inner hub. The outer ring is made of a material suitable for aiding a teething child such as a semi-hard rubber or plastic, and is selectively dipped in a material most suitable for allowing the child to chew upon. The outer ring is sized so that the child cannot place more than a minor arc thereof in his or her mouth. The inner hub has a vibration mechanism which includes a motor that drives an eccentric weight for generating a vibration sensation. The vibration sensation is transmitted to the outer ring through the spokes. The vibration mechanism, and all electromechanical components associated therewith are fully contained within the inner hub and are thereby safely protected from the child.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
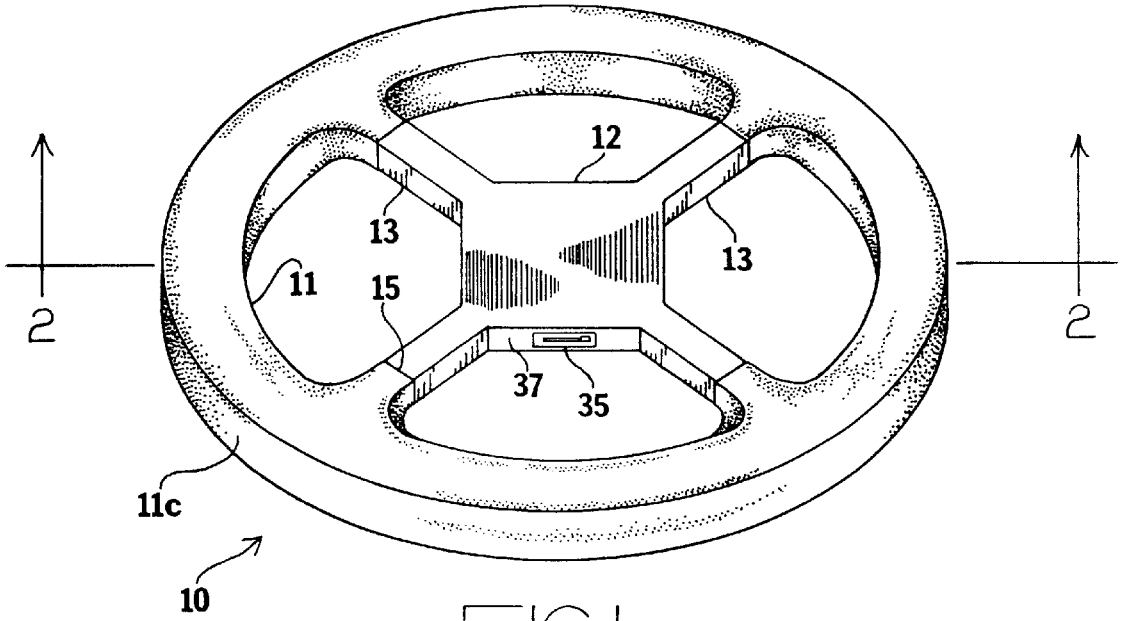
FIG. 1 is a diagrammatic perspective view, illustrating a teething ring according to the present invention.

FIG. 1 illustrates a teething ring 10. The teething ring 10 comprises an outer ring 11 having an outer circumference 11C, and an inner hub 12. The outer ring 11 and inner hub 12 are connected with spokes 13.

The outer ring 11 has a similar consistency and hardness as ordinary teething rings typically provided to children. In other words, the outer ring 11 is made of a semi-hard rubber or plastic. In fact, the outer ring 11 typically has a coating 15 which is applied thereon by dipping the outer ring 11 in a plastic or rubber substance. Preferably, the coating 15 extends onto the spokes partially toward the hub 12, or generally to any area which might come into contact with the child's mouth. The outer ring is sized so that that child cannot place more than a minor arc of the outer circumference outer ring into his or her mouth at any one time. In other words, the child should not be able to place more than the circumferential distance on the outer ring between two adjacent spokes 13 into the mouth.

The inner hub 12 is substantially coplanar with the outer ring 11. Since the inner hub 12 does not substantially project beyond the outer ring 11, it is difficult if not impossible for the child to place his or her mouth around the inner hub 12.

Figure 2:
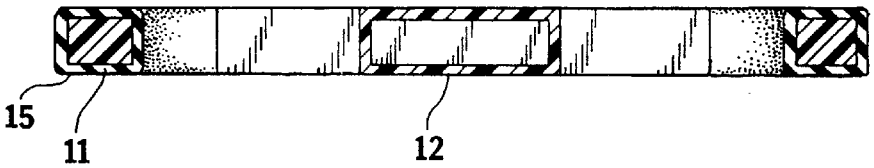
FIG. 2 is a cross sectional view of the teething ring, with electromechanical components of the vibration mechanism removed therefrom.

Referring to FIG. 2, the outer ring 11 is substantially solid, encircled by the coating 15. However, the inner hub 12 is substantially hollow to allow electromechanical components of the teething ring to be enclosed therein.

Figure 3:
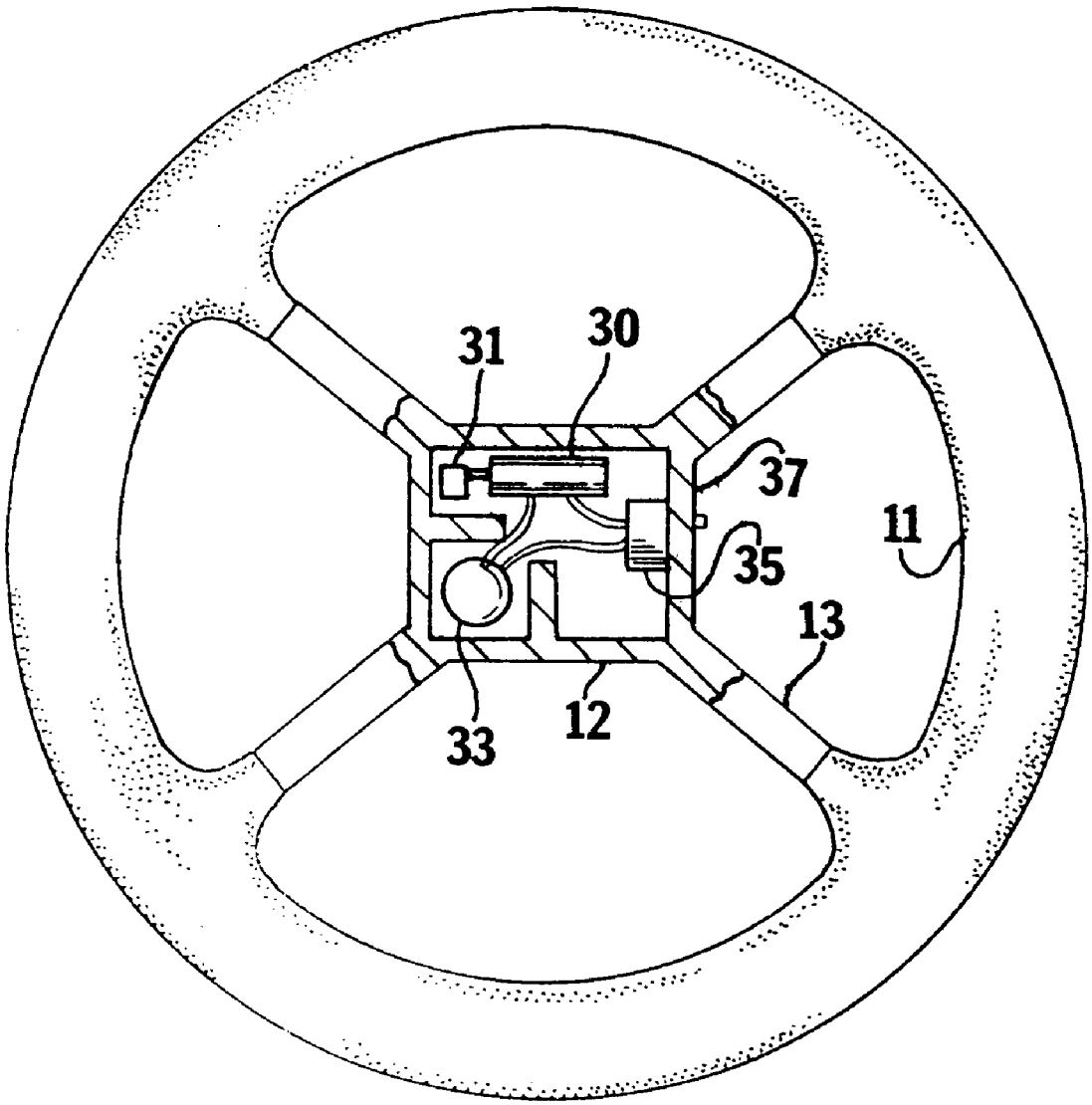
FIG. 3 is a top plan view of the invention, with a top portion of the hub and spokes removed therefrom, for illustrating the electro-mechanical components of the teething ring.

Now, referring to FIG. 3, the electromechanical components of the teething ring comprises a vibration mechanism, which preferably includes a miniature motor 30 and an eccentric weight 31 driven by the motor. As the motor 30 rotates the eccentric weight 31, the inherent "wobbling" created thereby causes the inner hub 12 to vibrate. This vibration is safely transferred to the outer ring 11 through the spokes 13. The electromechanical components also include a battery 33 for selectively powering the miniature motor 30 under the control of an on-off switch 35. Referring simultaneously to FIG. 1 and FIG. 3, the hub 12 has a side surface 37 between the inner hub 12 and the outer ring 11. The switch 35 is a water-proof switch which is operable at said side surface 37.

Thus, all electromechanical components are safely located within the hub 12. The vibration sensation is transmitted to the outer ring through the spokes. The child chewing upon the outer ring feels the vibration while chewing upon the outer ring. Since the child can only place a portion of the outer ring in his or her mouth, it is not possible for the child to place the inner hub having the electro-mechanical components into his or her mouth. Thus the child is safely isolated from all electromechanical components.

In conclusion, herein is presented a teething ring which has an outer hub which a child chews upon, and an inner hub connected to the outer hub with spokes. The inner hub contains a vibration mechanism which transmits a vibration sensation to the outer hub where the child can safely chew upon the outer hub without danger of injury from the electro-mechanical components in the hub.

What is claimed is:

1. A teething ring for use by a child, comprising:

an outer ring sized to allow a child to chew on the outer ring;

an inner hub located within the outer ring, the inner hub substantially planar with respect to the outer ring;

a plurality of spokes radially connecting the inner hub to the outer ring, the inner hub rigidly attached to the outer ring with the spokes; and a vibration mechanism comprising a plurality of electro-mechanical components which are entirely located within the inner hub, the vibration mechanism producing a vibrating sensation which is transmitted to the outer ring through the spokes.

2. The teething ring as recited in claim 1, wherein the outer ring is dipped in a coating substance selected from a group of plastic and rubber to effectively cover surfaces of the outer ring.

3. The teething ring as recited in claim 2, wherein the vibration mechanism comprises a motor, an eccentric weight driven by the motor, a battery for powering the motor, and a switch for selectively allowing power to the motor from the battery.

4. The teething ring as recited in claim 3, wherein the switch is a waterproof switch that is mounted within the inner hub so that control of said switch is provided on a side surface of said inner hub.

* * * * *